US005697870A

United States Patent [19]

Osborn

[11] Patent Number: 5,697,870

[45] Date of Patent: Dec. 16, 1997

[54] PORTABLE STEPPING EXERCISER WITH STORAGE COMPARTMENTS

[76] Inventor: Melissa Osborn, 14764 County Road 9, Summerdale, Ala. 36580

[21] Appl. No.: 705,292

[22] Filed: Aug. 29, 1996

[51] Int. Cl.[6] ..... A63B 3/00; A63B 21/00

[52] U.S. Cl. ..... 482/52; 482/51

[58] Field of Search ..... 482/51, 52, 15, 482/23, 92

[56] References Cited

U.S. PATENT DOCUMENTS

| | | | |
|---|---|---|---|
| 4,856,775 | 8/1989 | Colledge | 482/142 |
| 5,050,861 | 9/1991 | Thomas et al. | 272/70 |
| 5,125,646 | 6/1992 | Wilkinson | 482/52 |
| 5,176,596 | 1/1993 | Ullman | 482/52 |
| 5,290,210 | 3/1994 | Hand et al. | 482/51 |
| 5,322,490 | 6/1994 | Van Der Hoeven | 482/52 |
| 5,354,247 | 10/1994 | Wilkinson | 272/70 |
| 5,447,216 | 9/1995 | Freyvogel | 206/292 |
| 5,474,509 | 12/1995 | Hodgdon | 272/70 |
| 5,599,258 | 2/1997 | Stone et al. | 482/51 X |

*Primary Examiner*—Richard J. Apley
*Assistant Examiner*—Denise Pothier
*Attorney, Agent, or Firm*—Patent & Trademark Services, Inc.; Joseph H. McGlynn; Thomas Zack

[57] ABSTRACT

An aerobic stepper having exercise related items and equipment stored therein. The stepper is made of an upper and lower locking section which, when locked together, can be carried as a unit by an external molded handle. The lower section has several compartments configured in shape and size to hold a water bottle, dumbbells and a folded towel. The upper section may store a folded workout mat which is retained by two straps having hook and loop end fasteners. The sections and internal compartment may be made by the plastic injection molding process or the blow molding process.

4 Claims, 2 Drawing Sheets

FIG. 1
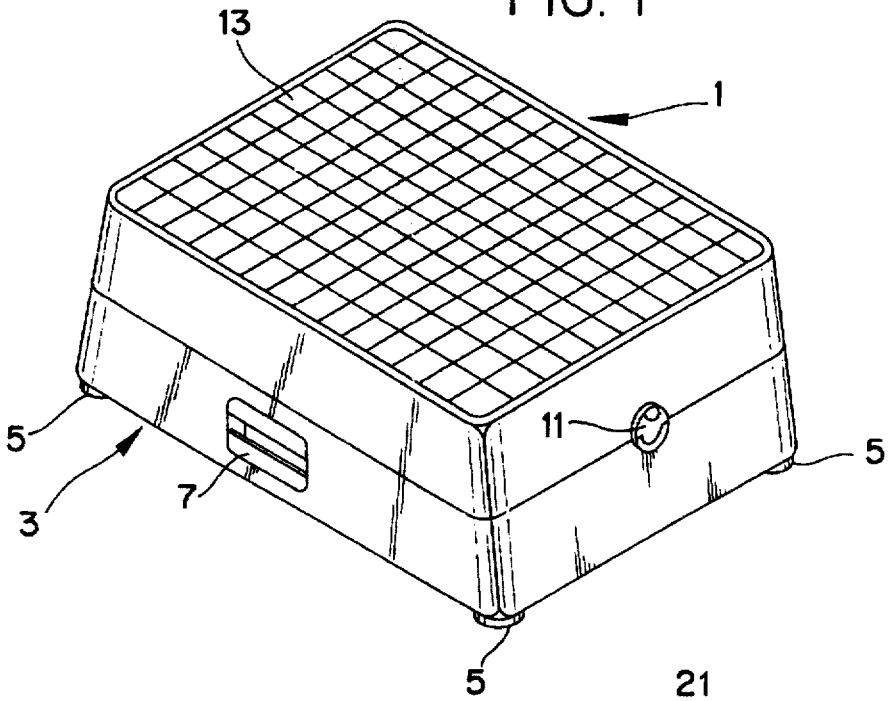
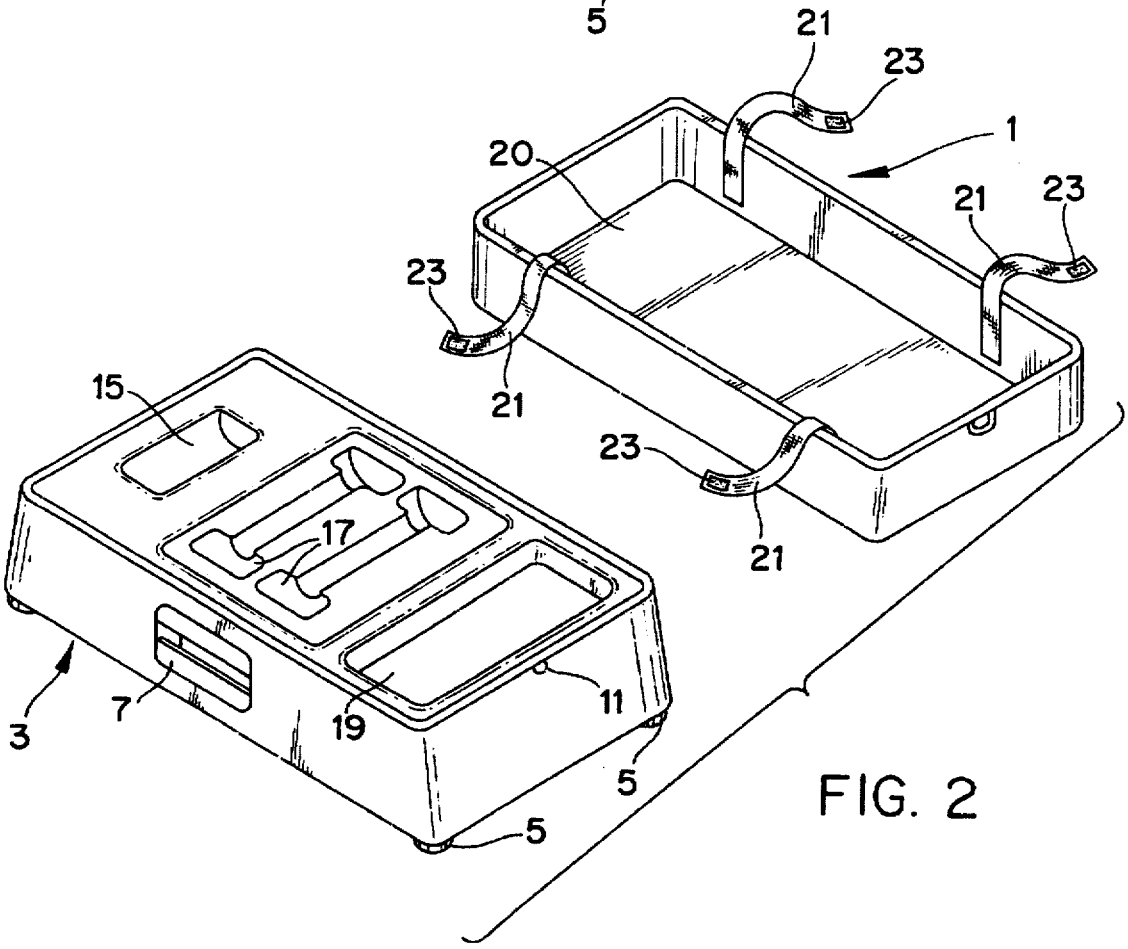
FIG. 2

PORTABLE STEPPING EXERCISER WITH STORAGE COMPARTMENTS

BACKGROUND OF THE INVENTION

In recent years the health benefits from exercising with aerobic steppers have become increasedly well known. These steppers may be adjusted to accommodate different vertical heights and may consists of different vertical step levels. Some provide for self-storing of such different vertical step levels while others may have hinged planar step surfaces which can be arranged to take into consideration different height levels.

DESCRIPTION OF THE PRIOR ART

Many of the prior art aerobic steppers recognize the desirability of being able to adjust their vertical step levels. For example, in U.S. Pat. No. 5,050,861 to Thomas et al. there is a stepper with an insert that adjusts the vertical stepper's height. The Ullman et al reference, U.S. Pat. No. 5,176,596, discloses a two part stepper in which the top can be positioned within the bottom at different heights. Further, in U.S. Pat. No. 5,354,247 to Wilkinson a modular stepper with multiple add-on steps the smaller of which can be stored in the largest step when not used is disclosed. And in U.S. Pat. No. 5,474,509 to Hodgdon a step platform with multiple hinged sections that can rearranged to adjust the step's height is set forth. None, however, provide for an aerobic stepper which can be used to store and carry exercise equipment or clothes as described and claimed in this specification.

SUMMARY OF THE INVENTION

An aerobic stepper having upper and lower interlocking sections. The lower section has built-in storage compartments for several exercise items and the upper section has sufficient storage capacity for a workout out which can be fastened therein. The storage compartments may be molded to the size and shape of conventional exercise items, including a water bottle, dumbbells and a towel. The upper section has retaining straps with Velcro TM end fasteners. An exterior built-in handle is used to carry the latched upper and lower sections.

It is the primary object of the present invention to provide for an improved aerobic stepper.

Another object is to provide for an aerobic stepper which has a removable top and can be used to both stored and carry exercise equipment or clothes.

These and other objects and advantages of the present invention will become apparent to readers from a consideration of the ensuing description and the accompanying drawings.

BRIEF DESCRIPTION OF THE DRAWINGS

FIG. 1 is a top perspective view of the invention's preferred embodiment.

FIG. 2 is a top perspective view of the invention with its top section removed.

DESCRIPTION OF THE PREFERRED EMBODIMENT

Figure 3:
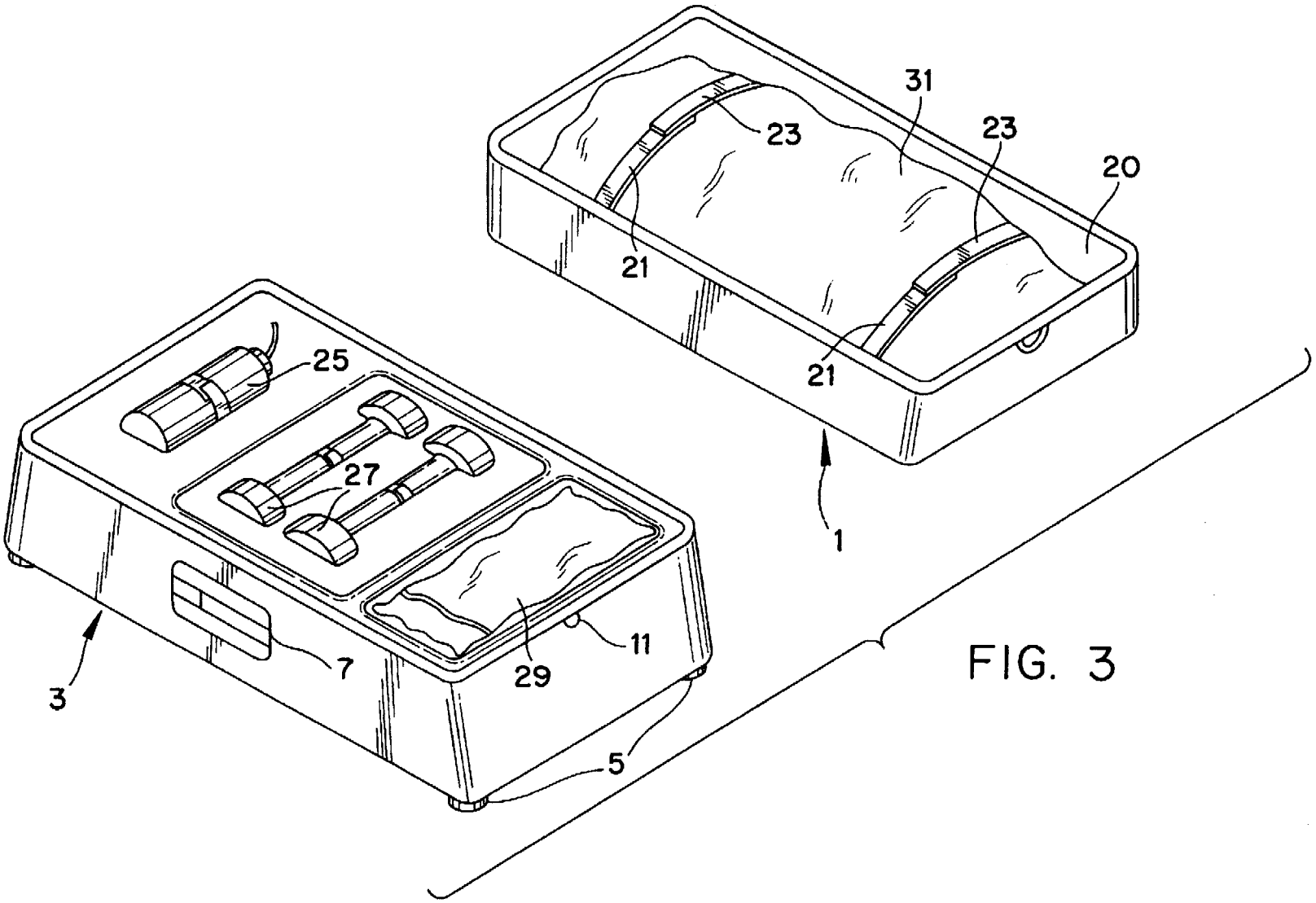
FIG. 3 shows the FIG. 2 embodiment with exercised items and clothing stored in its sections.

FIG. 1 is a top perspective view of the invention's preferred embodiment. A upper rectangular hollow section 1 having four rounded corners sits over a lower hollow rectangular section 3 having complementary interfacing joining edges. Both sections have downwardly sloping sides while the lower section has four (three shown) nonslip rubber floor engaging feet 5 located at its four corners on the bottom of the lower section. This section also has a recessed handle 7 molded into the lower section's front to permit carrying of the two sections. Extending from the upper section 1 is a means for locking 11 the upper section 1 and lower section 3 together to permit their carrying by the handle 7. A non-slip rubber surface 13 covers the upper section's feet engaging horizontally disposed upper surface. Both the upper and lower sections can be made of a strong lightweight molded plastic material.

FIG. 2 is a top perspective view of the invention with its top section 1 removed from the bottom section 3. As shown the bottom section has a partially hollow interior having molded compartments specifically designed to accommodate and store exercise related equipment. This includes an indented molded compartments one of which 15 is sized and configured to fit a water bottle; two indented others 17 sized and configured to fit two dumbbell weights; and a third rectangular indented compartment 19 into which a folded towel may fit. The upper section 1 has a substantially more hollow interior 20 to accommodate protruding items in the lower section when seated thereon and folded items in the upper section. Each side of the upper section has two facing straps 21 each with end hook and loop or Velcro TM fasteners 23.

FIG. 3 shows the FIG. 2 embodiment with exercised items and clothing stored in its two open sections. As depicted, lower section 1 has molded indented hollow compartments 15–19, respectively, having the following stored conventional exercised related items: a water bottle 25 with a built-in drinking straw, two solid dumbbells 27 and a folded towel 29.

The upper section 1 has a large workout mat 31 folded upon itself and secured in place by the two joined straps 21.

The primary components, including the sections 1 and 3, of the invention's preferred embodiment can be manufactured using the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the two sections and the internal compartments). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price.

These same section components may also be manufactured using the blow molding process. The process uses a parison (hollow tube) of plastic, and at minimum of a two part mold. This parison is heat softened and a two part cavity mold is placed around the tube. The mold pinches off one end of the tube while very hot air is blown into the other end of the plastic tube. This causes the tube to blow up like a balloon against the mold and take its shape. The two part mold is opened and the enclosure ejected and allowed to cool and harden. Thereafter second stage cutting and trimming by hand or machine can take place. Polyethylene plastic is often used in this process because of its waxy feeling and its ability to slide well within the mold. Textures can also be added to the outer surface to give it the appear of the All In 1 Step.

Both the plastic injection molding process and the blow molding process represent cost effective ways of mass producing the ALL In 1 Step. The particular plastic material used may be high impact automotive grade ABS (Acrylonitrile-butadiene-styrene) plastic or polyethylene plastic. The other items used in the preferred embodiment such as the latches 9, water bottle 25, dumbbells 27 and other accessories are available conventional off the shelf items and commercially available. The Thomas Register for commercial sources of such items can be consulted for suppliers.

Clearly, the specific exercise related items stored or carried in the preferred embodiment may be changed. For example, a first aid or other kit could also be included in place of or in addition to the other stored or carried items in the lower and upper sections.

Although the All In 1 Step and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An aerobic stepper comprising:

upper and a lower interlocking hollow housing sections, one of said sections having built-in indented storage compartments for exercise related items and the other section being adapted to store additional exercise related items in its hollow section;

means for locking the upper and lower hollow sections together and any stored items therein;

a horizontally disposed flat section surface with a non-slip surface thereon to engage a user's feet on the upper section while supporting a user during exercising; and at least one non-slip engaging member on the bottom of the lower section to engage the floor.

2. The invention as claimed in claim 1, wherein said lower section has said built-in storage compartments and said upper section has straps with fasteners for retaining a workout mat.

3. The invention as claimed in claim 2, wherein said lower storage compartments are molded to the size and shape of a water bottle, dumbbells and a folded towel.

4. The invention as claimed in claim 2, wherein said upper section's retaining straps have end hook and loop fasteners and said lower section has an exterior built-in carrying handle adapted to carry the upper and lower sections when locked together.

* * * * *